US009966039B2

(12) United States Patent
Su et al.

(10) Patent No.: US 9,966,039 B2
(45) Date of Patent: May 8, 2018

(54) METHOD AND DEVICE FOR MODULATING IMAGE DISPLAY QUALITY OF DISPLAY DEVICE AMONG DIFFERENT GRAY LEVELS

(71) Applicants: BOE TECHNOLOGY GROUP CO., LTD., Beijing (CN); BEIJING BOE DISPLAY TECHNOLOGY CO., LTD., Beijing (CN)

(72) Inventors: Wengang Su, Beijing (CN); Daekeun Yoon, Beijing (CN); Weihao Hu, Beijing (CN); Lei Liu, Beijing (CN); Yangbing Yu, Beijing (CN)

(73) Assignees: BOE TECHNOLOGY GROUP CO., LTD. (CN); BEIJING BOE DISPLAY TECHNOLOGY CO., LTD. (CN)

( * ) Notice: Subject to any disclaimer, the term of this patent is extended or adjusted under 35 U.S.C. 154(b) by 161 days.

(21) Appl. No.: 14/426,030

(22) PCT Filed: Aug. 1, 2014

(86) PCT No.: PCT/CN2014/083573

§ 371 (c)(1),
(2) Date: Mar. 4, 2015

(87) PCT Pub. No.: WO2015/113390

PCT Pub. Date: Aug. 6, 2015

(65) Prior Publication Data

US 2016/0042718 A1 Feb. 11, 2016

(30) Foreign Application Priority Data

Jan. 28, 2014 (CN) ..... 2014 1 0041758

(51) Int. Cl.
*G09G 5/10* (2006.01)
*G09G 3/00* (2006.01)

(52) U.S. Cl.
CPC ..... *G09G 5/10* (2013.01); *G09G 3/006* (2013.01); *G09G 2320/029* (2013.01); *G09G 2320/0257* (2013.01); *G09G 2320/0276* (2013.01)

(58) Field of Classification Search
None
See application file for complete search history.

(56) References Cited

U.S. PATENT DOCUMENTS

2003/0142363 A1 7/2003 Oota
2012/0120124 A1* 5/2012 Zhang ..... G09G 3/3648 345/690

(Continued)

FOREIGN PATENT DOCUMENTS

CN 1477614 A 2/2004
CN 101645244 A 2/2010

(Continued)

OTHER PUBLICATIONS

Office Action in Chinese Patent Application No. 201410041758.X, dated Sep. 18, 2015.

(Continued)

*Primary Examiner* — Chad Dicke
(74) *Attorney, Agent, or Firm* — Brooks Kushman P.C.

(57) ABSTRACT

The present disclosure provides a method and a device for modulating image display quality of a display device. The method includes: debugging a display device to a modulation state, so that a common voltage of the display device corresponding to a predetermined gray level is a standard voltage; and modulating a common voltage of the display device corresponding to other controllable gray level into a preset value, wherein there is a first preset relationship between the preset value and the standard voltage.

6 Claims, 6 Drawing Sheets

(56) References Cited

U.S. PATENT DOCUMENTS

| | | | | |
|---|---|---|---|---|
| 2013/0194170 | A1* | 8/2013 | Saitoh | G09G 3/20 345/103 |
| 2013/0321489 | A1* | 12/2013 | Kishikawa | G09G 3/22 345/690 |

FOREIGN PATENT DOCUMENTS

| | | | |
|---|---|---|---|
| CN | 102651190 | A | 8/2012 |
| CN | 103810963 | A | 5/2014 |

OTHER PUBLICATIONS

International Search Report and Written Opinion in PCT International Application No. PCT/CN2014/083573, dated Oct. 27, 2014.

* cited by examiner

METHOD AND DEVICE FOR MODULATING IMAGE DISPLAY QUALITY OF DISPLAY DEVICE AMONG DIFFERENT GRAY LEVELS

CROSS-REFERENCE TO RELATED APPLICATION

This application is the U.S. national phase of PCT Application No. PCT/CN2014/083573 filed on Aug. 1, 2014, which claims a priority of the Chinese patent application No. 201410041758.X filed on Jan. 28, 2014, which is incorporated herein by reference in its entirety.

TECHNICAL FIELD

The present disclosure relates to the field of display technology, in particular to a method and a device for modulating image display quality of a display device.

BACKGROUND

During the display of a display device, there shows a nonlinear relationship between an input voltage applied to a pixel and pixel brightness/transmittance, which is reflected by a curve known as gamma curve.

In the use, an existing display device is required to perform voltage conversion based on a preset gamma characteristic curve, and a difference between a gamma value of an actual gamma characteristic curve of a display device and a target gamma value (generally 2.2) determines a final display effect (the smaller the difference, the better the display effect).

Therefore, the display device needs to be debugged before it leaves the factory, so as to obtain a gamma curve with a gamma value close to the target gamma value as possible, thereby to guarantee image display quality of the display device.

However, an existing debugging method can only ensure the display quality of an individual pattern, but cannot be applicable to all display devices, particularly a large-sized display device, e.g., such products as TV. As image display effects may be greatly differed due to the nonlinear brightness of the display device, such a phenomenon as image sticking will occur, and as a result, it is unable to obtain the desired image display quality.

SUMMARY

An object of the embodiments of the present disclosure is to provide a method and a device for modulating image display quality, so as to improve the image display quality of a display device.

The present disclosure provides in one embodiment a method for modulating image display quality, which includes the following steps;

debugging a display device to a modulation state, so that a common voltage of the display device corresponding to a predetermined gray level is a standard voltage; and modulating a common voltage of the display device corresponding to the other controllable gray level into a preset value, wherein there is a first preset relationship between the preset value and the standard voltage.

Alternatively, the step of debugging the display device to the modulation state includes:

aging the display device for a preset period of time; and modulating an image flicker of the display device into a predetermined value.

Alternatively, the predetermined value is a minimal value.

Alternatively, the step of debugging the display device to the modulation state includes:

acquiring a first display parameter of the display device, and constructing a first gamma curve based on the first display parameter; and adjusting the first display parameter of the display device to a second display parameter, so that a gamma value of a second gamma curve of the display device corresponding to the second display parameter is within a predetermined range.

Alternatively, the predetermined range is between 2.0 and 2.4.

Alternatively, the first preset relationship is that:

the preset value is equal to the standard voltage; or a difference between the preset value and the standard voltage is within a preset range.

Alternatively, the step of modulating the common voltage of the display device corresponding to the other controllable gray level into the preset value includes:

acquiring the common voltage corresponding to the other controllable gray level; and adjusting the common voltage corresponding to the other controllable gray level upward when the common voltage corresponding to the other controllable gray level is smaller than the preset value; or adjusting the common voltage corresponding to the other controllable gray level downward when the common voltage corresponding to the other controllable gray level is greater than the preset value.

Alternatively, subsequent to the step of modulating the common voltage of the display device corresponding to the other controllable gray level into the preset value, the method further includes:

constructing a third gamma curve based on a third display parameter of the modulated display device; and storing the third display parameter when a gamma value of the third gamma curve meets a preset requirement.

Alternatively, the predetermined gray level is gray level 127.

Alternatively, the other controllable gray levels include at least one of gray level 0, gray level 1, gray level 64, gray level 191, gray level 254 and gray level 255.

The present disclosure provides in another embodiment a device for modulating image display quality, which includes:

a debugging module configured to debug a display device to a modulation state, so that a common voltage of the display device corresponding to a predetermined gray level is a standard voltage; and a modulating module configured to modulate a common voltage of the display device corresponding to the other controllable gray level into a preset value, wherein there is a first preset relationship between the preset value and the standard voltage.

Alternatively, the debugging module includes:

an aging unit configured to age the display device for a preset period of time; and a modulating unit configured to modulate an image flicker of the display device into a predetermined value.

Alternatively, the predetermined value is a minimal value.

Alternatively, the debugging module includes:

a constructing unit configured to acquire a first display parameter of the display device and construct a first gamma curve based on the first display parameter; and a first adjusting unit configured to adjust the first display parameter of the display device to a second display parameter, so that a gamma value of a second gamma curve of the display device corresponding to the second display parameter is within a predetermined range.

Alternatively, the predetermine range is between 2.0 and 2.4.

Alternatively, the first preset relationship is that:

the preset value is equal to the standard voltage; or a difference between the preset value and the standard voltage is within a preset range.

Alternatively, the modulating module includes:

an acquiring unit configured to acquire the common voltage corresponding to the other controllable gray level; and a second adjusting unit configured to adjust the common voltage corresponding to the other controllable gray level upward when the common voltage corresponding to the other controllable gray level is smaller than the preset value; or adjust the common voltage corresponding to the other controllable gray level downward when the common voltage corresponding to the other controllable gray level is greater than the preset value.

Alternatively, the device further includes:

a constructing module configured to construct a third gamma curve based on a third display parameter of the modulated display device; and a storing module configured to store the third display parameter when a gamma value of the third gamma curve meets a preset requirement.

Alternatively, the predetermined gray level is gray level 127.

As can be seen from the above, according to the method and device for modulating the image display quality in the embodiments of the present disclosure, the display device is debugged to a modulation state, so that the common voltage of the display device corresponding to the predetermined gray level is the standard voltage. Then, the common voltage of the display device corresponding to other controllable gray level is modulated into the preset value, wherein there is the first preset relationship between the preset value and the standard voltage. As a result, it is able to maintain the common voltages corresponding to the respective gray levels in the display device at an identical level, thereby to minimize such a phenomenon as image sticking, and ensure the image display quality of the display device.

DETAILED DESCRIPTION

To make the objects, the technical solutions and the advantages of the present disclosure more apparent, the present disclosure will be described hereinafter in a clear and complete manner in conjunction with drawings and the embodiments. Based on the following embodiments, a person skilled in the art may obtain the other embodiments, and these embodiments also fall within the scope of the present disclosure.

Unless otherwise specified, the technical terms or scientific terms used herein shall be understood in a usual sense by a person skilled in the art. "First", "second", and the like used in the specification and claims of the present disclosure do not indicate any order, number or importance, but are merely used to distinguish different constituent parts. Likewise, "a", "one" and the like are not used to limit the number, but are used to indicate the existence of at least one. "Connection", "interconnection" and the like are not limited to physical connection or mechanical connection, but may include electrical connection, whether directly or indirectly. "Up", "down", "left", "right" and the like are merely used to indicate a relative position relation, and when an absolute position of an object to be described changes, the relatively positional relation changes accordingly.

Figure 1:
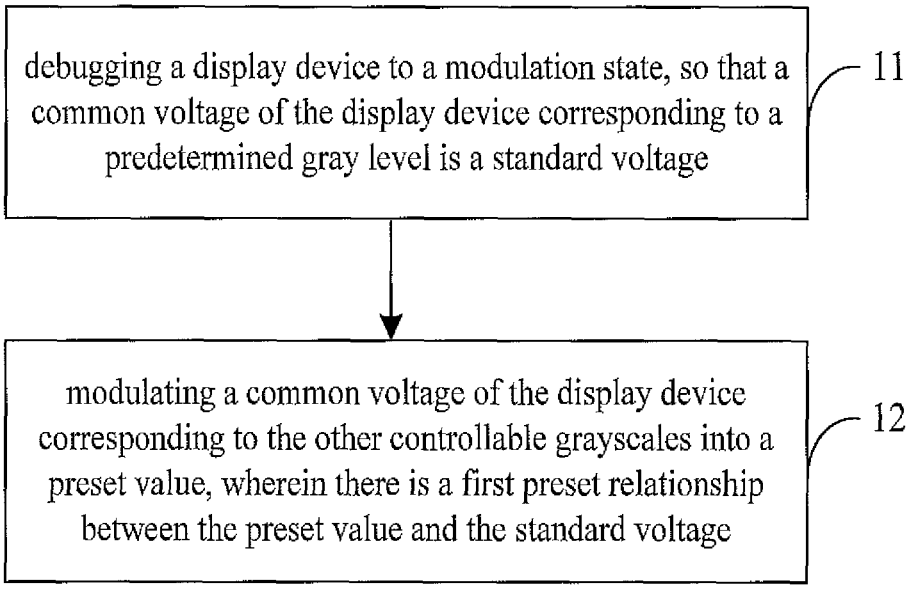
FIG. 1 is a flow chart showing a method for modulating image display quality according to one embodiment of the present disclosure.

The present disclosure provides in one embodiment a method for modulating image display quality, and as shown in FIG. 1, the method may specifically include:

step 11: debugging a display device 1 to a modulation state, so that a common voltage of the display device 1 corresponding to a predetermined gray level, e.g., gray level 127, is a standard voltage; and step 12: modulating a common voltage of the display device 1 corresponding to the other controllable gray level into a preset value, wherein there is a first preset relationship between the preset value and the standard voltage.

According to the method for modulating the image display quality in this embodiment, it is able to maintain the common voltages corresponding to the respective gray levels in the display device 1 at an identical level, thereby to minimize such a phenomenon as image sticking, and ensure the image display quality of the display device 1.

Figure 2:
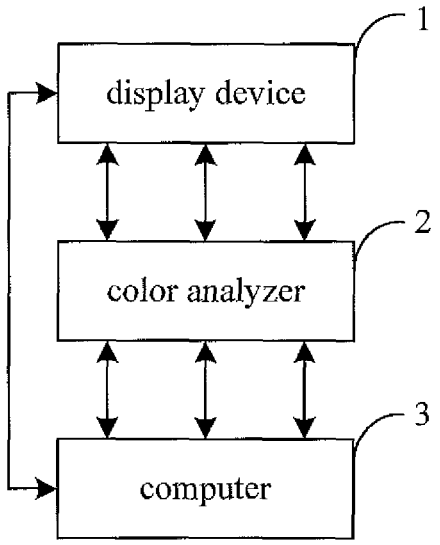
FIG. 2 is a schematic view showing a modulating platform involved in the method for modulating the image display quality according to one embodiment of the present disclosure.

The method for modulating the image display quality according to this embodiment of the present disclosure may be implemented on a modulating platform. As shown in FIG. 2, the modulating platform may specifically include the display device 1, a color analyzer 2 (CA310) and a computer 3 connected with each other via serial ports. The color analyzer 2 provides in real time relevant information, such as a color gamut value and a brightness reference value. The computer 3, as a bridge connecting the color analyzer 2 and the display device 1, takes charge of constructing relevant data of a gamma curve, and inputting a signal into the display device 1 via a serial port line.

In this embodiment, firstly, during the procedure of debugging the display device 1 to the modulation state, the display device 1 may be subjected to aging treatment for a preset period of time, for example 30 minutes, so as to ensure the respective members of the display device 1 to be in a normal working state, thereby to ensure accuracy for the subsequent modulation.

Then, an image flicker of the display device 1 may be captured by the color analyzer 2, so as to determine whether a current image flicker of the display device is the minimal value. When the image flicker is not the minimal value, a display parameter is modulated into the minimal value, or a parameter of the image flicker of the display device 1 is directly set as the minimal value.

Next, a file of a gamma curve may be constructed in the computer 3, the relevant information may be captured by the color analyzer 2 and input into the file of the gamma curve, so as to determine whether a certain requirement is met, i.e., whether a gamma value of the constructed gamma curve is within a range between 2.0 and 2.4. Illustratively, an optimal gamma value may be 2.2. If the certain requirement is not met, the debugging may be repeated until an optimal effect is achieved. The gamma curve constructed herein may specifically include a gamma curve corresponding to the respective gray levels in the display device 1, for example, a gamma curve corresponding to gray level 127.

In one embodiment of the present disclosure, the step of debugging the display device 1 to the modulation state may specifically include:

acquiring a first display parameter of the display device 1, and constructing a first gamma curve based on the first display parameter; and adjusting the first display parameter of the display device 1 to a second display parameter, so that a gamma value of a second gamma curve of the display device 1 corresponding to the second display parameter is within a range between 2.0 and 2.4.

The procedure of adjusting the gamma curve involves the adjustment of a common voltage corresponding to a gray level, so when a gamma value of a gamma curve corresponding to one gray level falls within a preset range or reaches an optimal value, the common voltage corresponding to this gray level may be taken as the standard voltage.

It should be appreciated that, the procedure of "debugging the display device 1 to the modulation state" in this embodiment of the present disclosure may include the steps of aging the display device 1, adjusting the imaging flicker, and constructing and adjusting the gamma curve performed in turn, or it may include merely the step of constructing and adjusting the gamma curve, or it may further include any other auxiliary operations.

Through the above-mentioned debugging, the display device 1 may be in an optimal modulation state. Due to the debugging of the gamma curve, the common voltages corresponding to the respective gray levels are each in a corresponding standard state, so as to facilitate the subsequent adjustments of the common voltages corresponding to the respective controllable gray levels.

Figure 3:
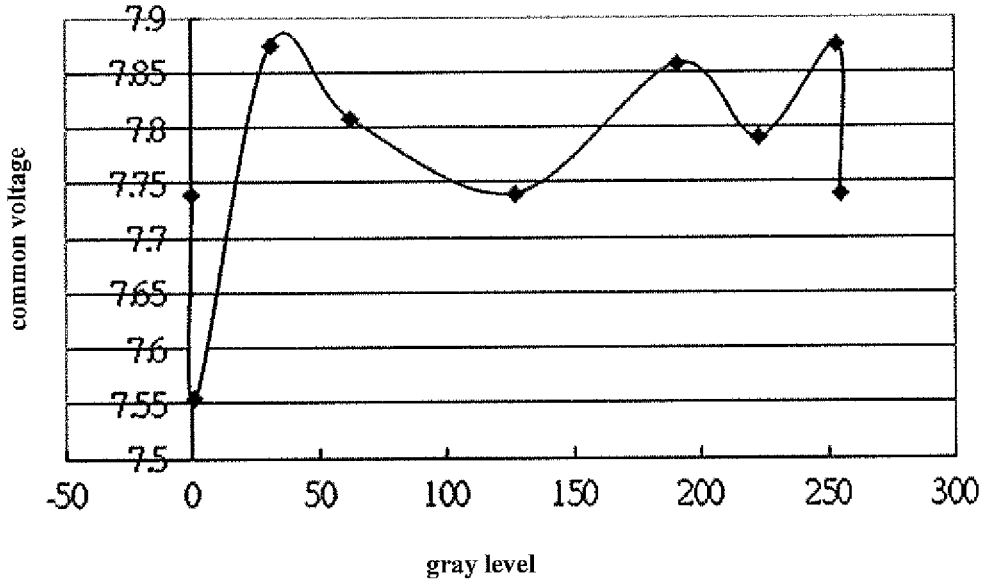
FIG. 3 is a schematic view showing unadjusted common voltages corresponding to the other controllable gray levels in the method for modulating the image display quality according to one embodiment of the present disclosure.

In general, the image flicker is adjusted at gray level 127, while an image sticking test is performed at gray level 0 and gray level 255. In this way, although the image flicker is adjusted at gray level 127, the image flickers corresponding to the other controllable gray levels are not adjusted and controlled yet, as shown in FIG. 3. Due to the unsynchronized image flickers, such a phenomenon as image sticking will occur for the other gray levels, and as a result, it makes very little sense to improve the image quality of the large-sized display device 1.

Figure 4:
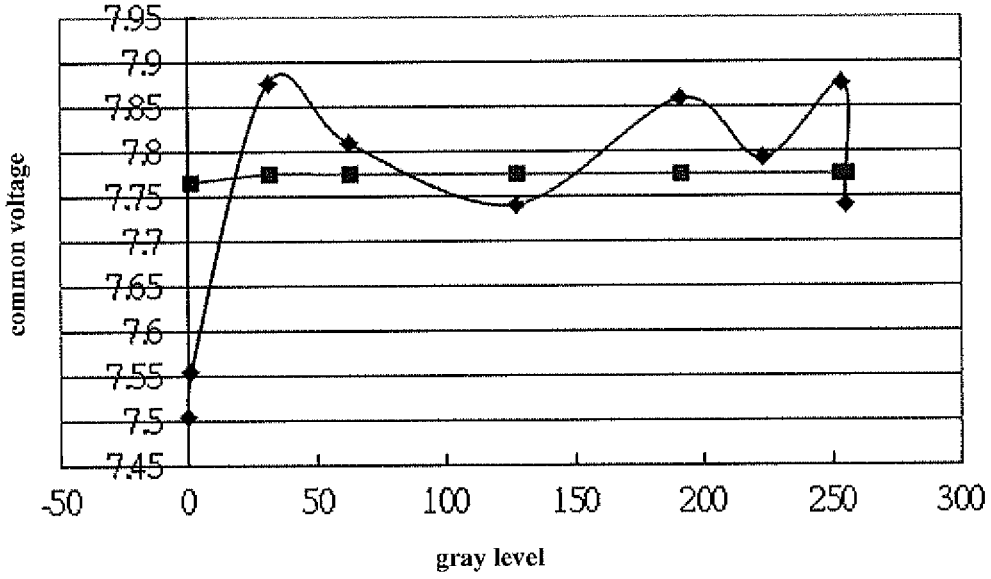
FIG. 4 is a schematic view showing the unadjusted and adjusted common voltages corresponding to the other controllable gray levels in the method for modulating the image display quality according to one embodiment of the present disclosure.

In this embodiment of the present disclosure, a target value of the common voltage corresponding to the respective controllable gray level is defined. For example, a common voltage corresponding to gray level 127 which has already been in the standard state is set as an ideal common voltage, and then the common voltages corresponding to the other controllable gray levels are adjusted so that there is a first preset relationship between the adjusted common voltages corresponding to the other controllable gray levels and the ideal common voltage (i.e., the common voltage corresponding to gray level 127). For example, The first preset relationship may be that: the adjusted common voltage is equal to the ideal common voltage, or a difference between the adjusted common voltage and the ideal common voltage is within a preset range, as shown in FIG. 4, so that the image flickers corresponding to the other controllable gray levels are the minimal value and identical to that corresponding to gray level 127. As a result, it is able to minimize such a phenomenon as image sticking, thereby to improve the image display quality of the display device 1.

In this embodiment of the present disclosure, the first preset relationship related in the step 12 may be that:

the preset value is equal to the standard voltage; or a difference between the preset value and the standard voltage is within a preset range.

The other controllable gray levels in the embodiment of the present disclosure may include at least one of gray level 0, gray level 1, gray level 64, gray level 191, gray level 254 and gray level 255.

In the embodiment of the present disclosure, the procedure of modulating the common voltages corresponding to the other controllable gray levels may be implemented on the basis of a difference $\Delta Vcom$ between the current common voltage of other controllable gray level and the ideal common voltage. To be specific, when the difference is negative, it means that the current common voltage corresponding to the other controllable gray level is smaller than the ideal common voltage, so the common voltage corresponding to the other controllable gray level may be adjusted upward so that a relationship between the common voltage corresponding to the other controllable gray level and the ideal common voltage meets the first preset relationship. When the difference is positive, it means that the current common voltage corresponding to the other controllable gray level is larger than the ideal common voltage, so the common voltage corresponding to the other controllable gray level may be adjusted downward so that a relationship between the common voltage corresponding to the other controllable gray level and the ideal common voltage meets the first preset relationship.

In the embodiment of the present disclosure, the procedure of modulating the common voltage of the display device 1 corresponding to the other controllable gray level into the preset value may specifically include:

acquiring the current common voltage corresponding to the other controllable gray level; and adjusting the common voltage corresponding to the other controllable gray level upward when the current common voltage corresponding to the other controllable gray level is smaller than the preset value, or adjusting the common voltage corresponding to the other controllable gray level downward when the current common voltage corresponding to the other controllable gray level is greater than the preset value.

After adjusting the common voltages corresponding to the respective gray levels, whether there is the first preset relationship between the common voltage corresponding to the respective gray level and the standard voltage may be detected. If not, the above procedure of adjusting the common voltage may be performed again, until there is the first preset relationship between the common voltage corresponding to the respective gray level and the standard voltage. If yes, a gamma curve may be constructed again based on the display parameter of the modulated display device 1, and whether a gamma value of such gamma curve is within an ideal range, e.g., between 2.0 and 2.4, may be determined. When the gamma value meets a certain requirement, the final, modulated display data is input into a corresponding module.

In the embodiment of the present disclosure, subsequent to the step of modulating the common voltage of the display device 1 corresponding to the other controllable gray level as the preset value, the method may further include:

constructing a third gamma curve based on a third display parameter of the modulated display device 1; and storing the third display parameter when a gamma value of the third gamma curve meets a preset requirement.

According to the method for modulating the image display quality in this embodiment of the present disclosure, it is able to minimize such a phenomenon as image sticking, thereby to improve the image display quality of the display device 1. In addition, this method can be implemented easily using the measured data, so an optimal debugging result will be achieved.

Figure 5:
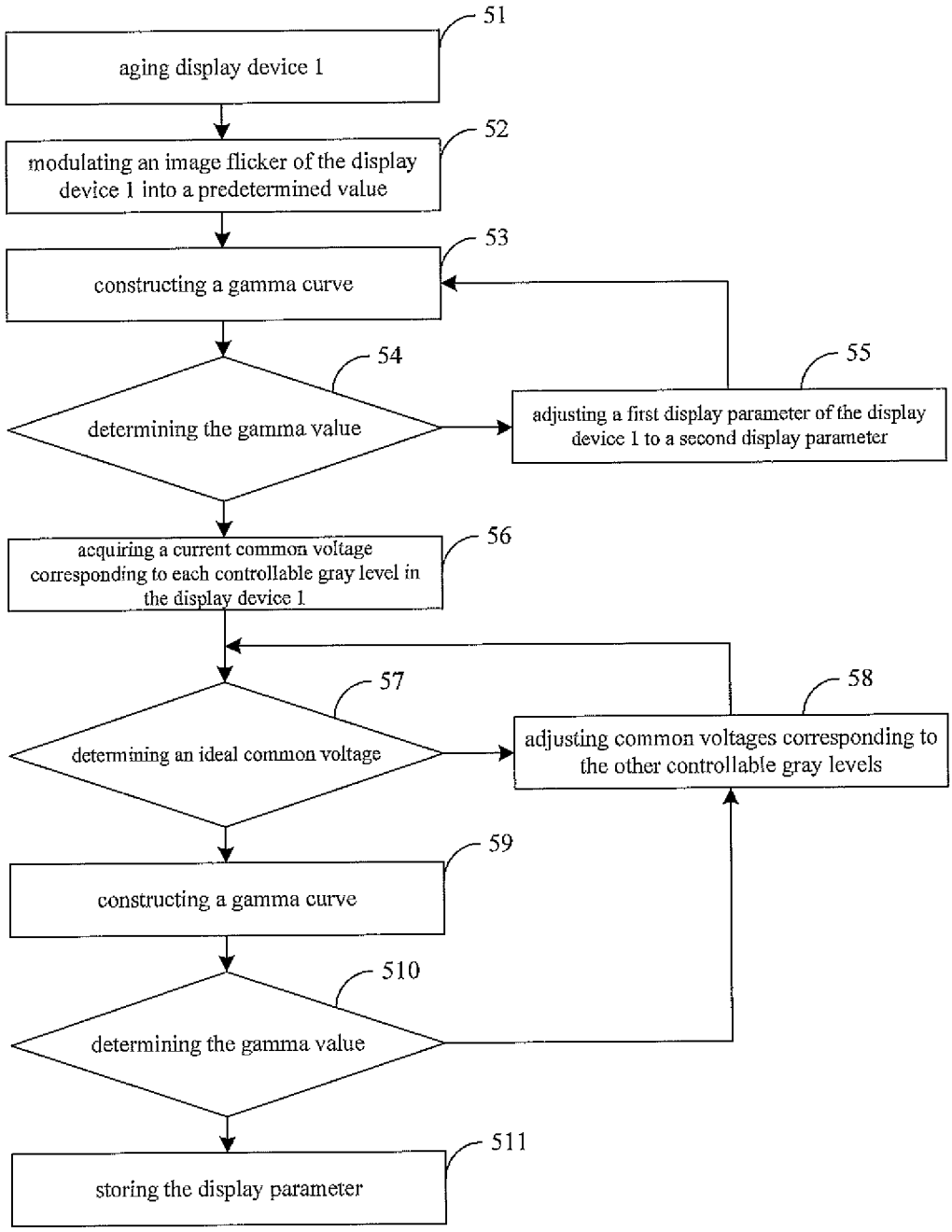
FIG. 5 is another flow chart showing the method for modulating the image display quality according to one embodiment of the present disclosure.

A specific procedure of implementing the method for modulating the image display quality in one embodiment of the present disclosure will be described in details in conjunction with FIG. 5.

Step 51: subjecting the display device 1 to aging treatment.

Step 52: setting an image flicker of the display device 1 to a predetermined value, for example, a minimal value.

Step 53: constructing a first gamma curve based on the first display parameter of the display device.

Step 54: determining whether a gamma value of the first gamma curve meets a certain requirement, if yes, proceeding to Step 56, and otherwise proceeding to Step 55.

Step 55: adjusting the first display parameter of the display device 1 to the second display parameter, so that a gamma value of a second gamma curve corresponding to the second display parameter meets a preset requirement, for example, within a range between 2.0 and 2.4, and returning to Step 53 after the adjustment.

When the gamma value corresponding to the gamma curve meets the preset requirement, the common voltage corresponding to the respective controllable gray level may be the standard voltage, so as to facilitate the subsequent adjustment of the common voltages corresponding to the controllable gray levels.

Step 56: acquiring the current common voltage corresponding to the other controllable gray level in the display device 1, and setting the current common voltage corresponding to gray level 127 as an ideal common voltage, for example, the preset value in Step 12.

In Step 56, the common voltages corresponding to gray level 0, gray level 1, gray level 64, gray level 127, gray level 191, gray level 254, gray level 255, and the like, may be acquired in the display device 1.

Step 57: determining whether a relationship between the current common voltage corresponding to the other controllable gray level and the ideal common voltage (which may be the current common voltage corresponding to gray level 127) meets the preset requirement, if yes, proceeding to Step 59, and otherwise proceeding to Step 58.

Step 58: adjusting the common voltages corresponding to the other controllable gray levels, and returning to Step 57 after the adjustment.

Specifically, when the current common voltage corresponding to the other controllable gray level is smaller than the ideal common voltage, the common voltage corresponding to the other controllable gray level is adjusted upward, or when the current common voltage corresponding to the other controllable gray level is larger than the ideal common voltage, the common voltage corresponding to the other controllable gray level is adjusted downward.

Step 59: constructing a third gamma curve based on a third display parameter of the adjusted display device 1.

Step 510: determining whether a gamma value corresponding to the third gamma curve constructed in Step 59 meets a preset requirement, if yes, proceeding to Step 511, and otherwise returning to Step 58.

Step 511: storing the current display parameter of the display device 1, for example, writing the parameters, such as the common voltages corresponding to the respective gray levels in the display device 1 into a corresponding module of the display device 1, so as to complete the above method for modulating the image display quality.

Figure 6:
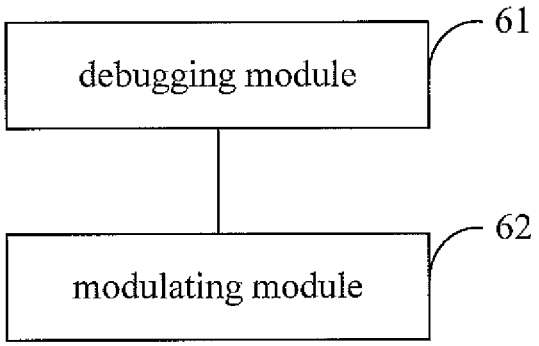
FIG. 6 is a schematic view showing a device for modulating image display quality according to one embodiment of the present disclosure.

The present disclosure provides in another embodiment a device for modulating image display quality, and as shown in FIG. 6, the device may specifically include:

a debugging module 61 configured to debug a display device 1 to a modulation state, so that a common voltage of the display device 1 corresponding to a predetermined gray level, e.g., gray level 127, is a standard voltage; and a modulating module 62 configured to modulate a common voltage of the display device 1 corresponding to the other controllable gray level into a preset value, wherein there is a first preset relationship between the preset value and the standard voltage.

Figure 7:
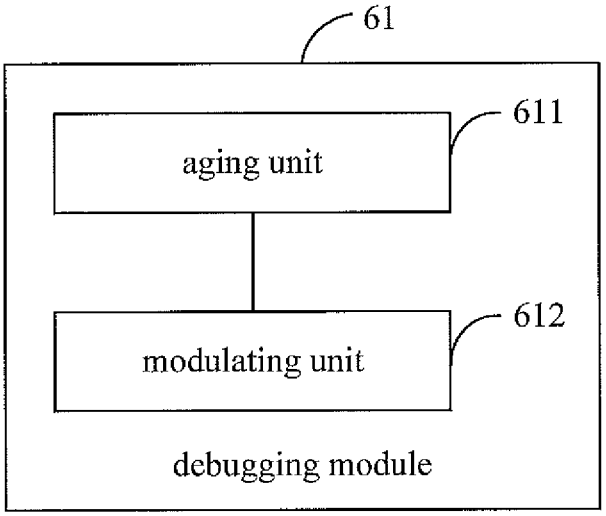
FIG. 7 is a schematic view showing a debugging module in the device for modulating the image display quality according to one embodiment of the present disclosure.

Alternatively, as shown in FIG. 7, the debugging module 61 may specifically include:

an aging unit 611 configured to age the display device 1 for a preset period of time; and a modulating unit 612 configured to modulate an image flicker of the display device 1 into a predetermined value.

Figure 8:
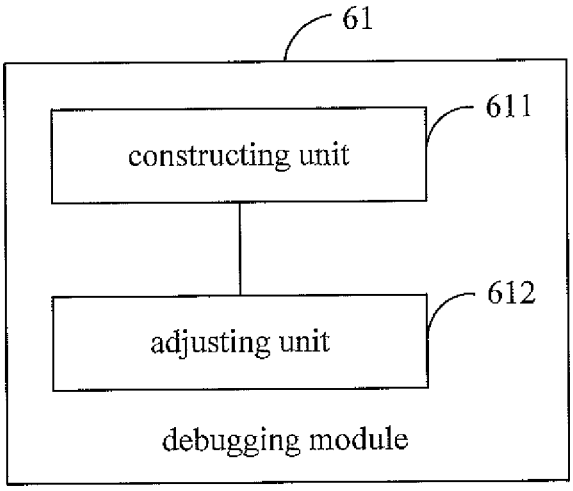
FIG. 8 is another schematic view showing the debugging module in the device for modulating the image display quality according to one embodiment of the present disclosure.

Alternatively, as shown in FIG. 8, the debugging module 61 may specifically include:

a constructing unit 613 configured to acquire a first display parameter of the display device 1 and construct a first gamma curve based on the first display parameter; and a first adjusting unit 614 configured to adjust the first display parameter of the display device 1 to a second display parameter, so that a gamma value of a second gamma curve of the display device 1 corresponding to the second display parameter is within a range between 2.0 and 2.4.

The first preset relationship mentioned in the above embodiment of the present disclosure may be that:

the preset value is equal to the standard voltage; or a difference between the preset value and the standard voltage is within a preset range.

Figure 9:
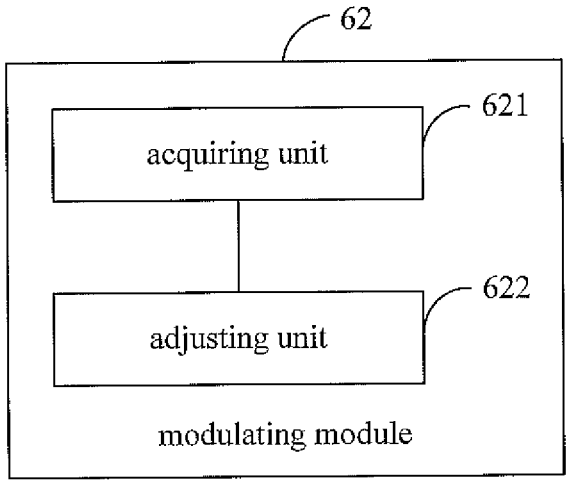
FIG. 9 is a schematic view showing a modulating module in the device for modulating the image display quality according to one embodiment of the present disclosure.

Alternatively, as shown in FIG. 9, the modulating module 62 may specifically include:

an acquiring unit 621 configured to acquire a current common voltage corresponding to the other controllable gray level; and a second adjusting unit 622 configured to adjust the common voltage corresponding to the other controllable gray level upward when the current common voltage corresponding to the other controllable gray level is smaller than the preset value, or adjust the common voltage corresponding to the other controllable gray level downward when the current common voltage corresponding to the other controllable gray level is greater than the preset value.

Figure 10:
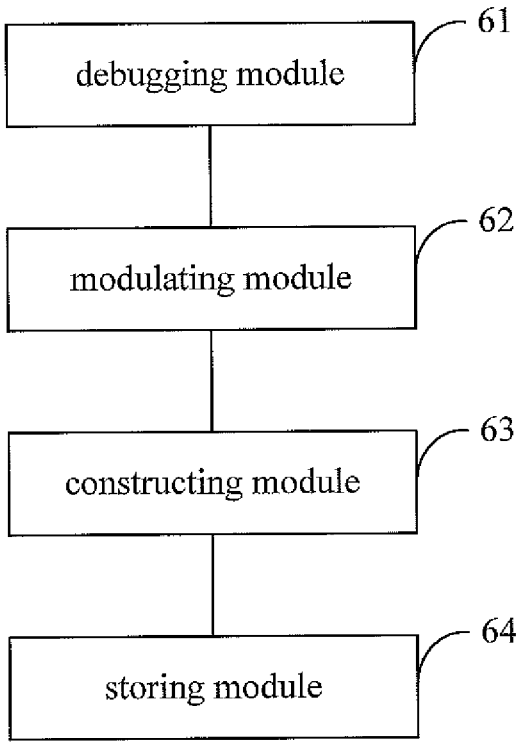
FIG. 10 is another schematic view showing the device for modulating the image display quality according to one embodiment of the present disclosure.

Alternatively, as shown in FIG. 10, the device for modulating the image display quality may specifically include:

a constructing module 63 configured to construct a third gamma curve based on a third display parameter of modulated display device; and a storing module 64 configured to store the third display parameter when a gamma value of the third gamma curve meets a preset requirement.

In summary, according to the method and device for modulating the image display quality in the embodiments of the present disclosure, the display device is debugged to a modulation state, so that the common voltage of the display device corresponding to the predetermined gray level is the standard voltage. Then, the common voltage of the display device corresponding to other controllable gray level is modulated into the preset value, wherein there is the first preset relationship between the preset value and the standard voltage. As a result, it is able to maintain the common voltages corresponding to the respective gray levels in the display device at an identical level, thereby to minimize such a phenomenon as image sticking, and ensure the image display quality of the display device.

The above are merely the preferred embodiments of the present disclosure. It should be noted that, a person skilled in the art may make further improvements and modifications without departing from the principle of the present disclosure, and these improvements and modifications shall also be considered as the scope of the present disclosure.

What is claimed is:

1. A method for modulating image display quality, comprising the following steps:

setting a display device to a modulation state, which comprises:

aging the display device for a preset period of time;

modulating an image flicker of the display device into a predetermined value;

acquiring a first display parameter of the display device, and constructing a first gamma curve based on the first display parameter;

adjusting the first display parameter of the display device to a second display parameter until a gamma value of a second gamma curve of the display device corresponding to the second display parameter is within a predetermined range; and setting a first common voltage to be a first value; and modulating a second common voltage into a second value, wherein the first common voltage is a common voltage of the display device corresponding to a predetermined gray level, the second common voltage is a common voltage of the display device corresponding to a controllable gray level other than the predetermined gray level, and the first value is equal to the second value, wherein the first display parameter and the second display parameter are gamut or brightness, and the step of modulating the second common voltage into the second value comprises:

acquiring the second common voltage; and adjusting the second common voltage upward when the second common voltage is smaller than the second value, or adjusting the second common voltage downward when the second common voltage is greater than the second value.

2. The method according to claim 1, wherein the predetermined value is a minimal value.

3. The method according to claim 1, wherein the predetermined range is between 2.0 and 2.4.

4. The method according to claim 1, wherein subsequent to the step of modulating the second common voltage into the second value, the method further comprises:

constructing a third gamma curve based on a third display parameter of the modulated display device; and storing the third display parameter when a gamma value of the third gamma curve meets a preset requirement.

5. The method according to claim 1, wherein the predetermined gray level is gray level 127.

6. The method according to claim 1, wherein the controllable gray level comprises at least one of gray level 0, gray level 1, gray level 64, gray level 191, gray level 254 and gray level 255.

* * * * *